US011891894B2

(12) United States Patent
Jamison et al.

(10) Patent No.: US 11,891,894 B2
(45) Date of Patent: Feb. 6, 2024

(54) PULSED-POWER DRILLING FLUID PROPERTY MANAGEMENT USING DOWNHOLE MIXER

(71) Applicant: Halliburton Energy Services, Inc., Houston, TX (US)

(72) Inventors: Dale E. Jamison, Humble, TX (US); William Walter Shumway, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 52 days.

(21) Appl. No.: 17/634,849

(22) PCT Filed: Sep. 24, 2019

(86) PCT No.: PCT/US2019/052635

§ 371 (c)(1),
(2) Date: Feb. 11, 2022

(87) PCT Pub. No.: WO2021/061103

PCT Pub. Date: Apr. 1, 2021

(65) Prior Publication Data

US 2022/0282575 A1 Sep. 8, 2022

(51) Int. Cl.
*E21B 7/15* (2006.01)
*E21B 21/08* (2006.01)

(52) U.S. Cl.
CPC ..... *E21B 7/15* (2013.01); *E21B 21/08* (2013.01)

(58) Field of Classification Search
CPC ..... E21B 7/15; E21B 21/08; E21B 21/00
See application file for complete search history.

(56) References Cited

U.S. PATENT DOCUMENTS 5,201,491 A * 4/1993 Domangue ..... E21B 34/02 251/363
7,530,406 B2 5/2009 Moeny et al.
(Continued)

FOREIGN PATENT DOCUMENTS

CN 102678044 9/2012
EP 1398456 3/2004

OTHER PUBLICATIONS

International Search Report and Written Opinion for PCT Patent Application No. PCT/US2019/052635, dated Jun. 19, 2020; 18 pages.

*Primary Examiner* — Brad Harcourt
(74) *Attorney, Agent, or Firm* — DeLizio, Peacock, Lewin & Guerra, LLP

(57) ABSTRACT

The present disclosure relates to a pulsed-power drilling system that includes downhole mixers for restoring optimal electrical properties in drilling fluid. The downhole mixer may include a housing having an uphole and downhole end, a channel to convey the drilling fluid through the housing, and a flow restrictor including an orifice having a fixed diameter positioned in the channel between the entrance and the exit of the channel to create a pressure drop between the entrance and the exit of the channel during a drilling operation. The pressure drop increases shear stress in the drilling fluid to manage electrical properties, such as a dielectric constant, of the drilling fluid. The electrical properties of the drilling fluid facilitate the formation of an electrical arc on a drill bit of the pulsed-power drilling system.

19 Claims, 8 Drawing Sheets

(56) References Cited

U.S. PATENT DOCUMENTS

| | | | | |
|---|---|---|---|---|
| 8,527,100 | B2 | 9/2013 | Russell et al. | |
| 2003/0121701 | A1* | 7/2003 | Polizzotti | E21B 36/008 175/424 |
| 2006/0037779 | A1 | 2/2006 | Moeny et al. | |
| 2007/0181313 | A1 | 8/2007 | Churchill | |
| 2011/0214498 | A1 | 9/2011 | Rezgui et al. | |
| 2015/0322326 | A1 | 11/2015 | Van Slyke et al. | |
| 2016/0060961 | A1* | 3/2016 | Dirksen | E21B 17/00 175/16 |
| 2016/0201458 | A1* | 7/2016 | Hanby | G01N 21/78 436/30 |
| 2017/0158938 | A1 | 6/2017 | Rodney | |
| 2018/0194987 | A1 | 7/2018 | Van Slyke et al. | |
| 2018/0201823 | A1* | 7/2018 | Van Slyke | C09K 8/26 |

* cited by examiner

PULSED-POWER DRILLING FLUID PROPERTY MANAGEMENT USING DOWNHOLE MIXER

RELATED APPLICATIONS

This application is a U.S. National Stage Application of International Application No. PCT/US2019/052635 filed Sep. 24, 2019, which designates the United States.

TECHNICAL FIELD

The present disclosure relates generally to pulsed-power drilling operations and, more particularly, to managing electrical properties of a pulsed-power drilling fluid.

BACKGROUND

Pulsed-power drilling uses pulsed-power technology to drill a wellbore in a rock formation by repeatedly applying a high electric potential across one or more electrode of a pulsed-power drill bit, which ultimately causes the surrounding rock to fracture. The fractured rock is carried away from the bit by drilling fluid and the bit advances downhole. The drilling fluid used in pulsed-power drilling operations is typically a complex emulsified mixture specifically formulated to have certain physical and electrical properties.

Drilling fluids used in pulsed-power drilling electrically isolate the electrodes from the adjacent drill bit components and have sufficient electrical properties to drive an electrical arc into the rock formation to drill a wellbore. Generally, there is a desirable and useful differential in the electrical properties, for example the dielectric constant, between the drilling fluid and the rock formation.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

The present disclosure relates to a downhole drilling tool that includes one or more downhole mixers designed to manage the electrical properties of pulsed-power drilling fluid used during a drilling operation. The downhole drilling tool for the drilling operation may use various pulsed-power technologies, including electrocrushing and electrohydraulic drilling technologies for example, to fracture rock formations by repeatedly delivering high-energy electrical pulses and/or high-energy shock waves to a rock formation through a drill bit. To generate these high-energy electrical pulses, the downhole drilling tool uses pulsed-power drilling fluids to direct an arc of electric current through a portion of the rock in the formation. The pulsed-power drilling fluids are typically emulsions (also referred to as emulsified mixtures and emulsified drilling fluids) that have certain electrical properties, such as a high dielectric constant and dielectric strength, and a low electrical conductivity. The electrical properties of the pulsed-power drilling fluid may change during the drilling operation as a result of the fluid remaining static either during operation of the downhole drilling tool or when the downhole drilling tool is not operating. To restore the optimal electrical properties, the pulsed-power drilling fluids may require mixing within a wellbore. Therefore, each downhole mixer is designed to manage the electrical properties of pulsed-power drilling fluid during a drilling operation, for example, by maintaining an optimum or desired difference in the dielectric constant between the drilling fluid and the rock formation. Preferably, the dielectric constant of the drilling fluid is managed such that it remains higher than the dielectric constant of the rock formation.

Although electrocrushing technology is often used herein as an example, the methods and devices disclosed herein can be used with any pulsed-power drilling system, and any pulsed-power drill bit that uses a pulsed-power drilling fluid may benefit from the downhole mixer of the present disclosure.

There are numerous ways in which a downhole mixer may be implemented in a pulsed-power drilling system. Thus, embodiments of the present disclosure and its advantages are best understood by referring to FIGS. 1 through 9, where like numbers are used to indicate like and corresponding parts.

Figure 1:
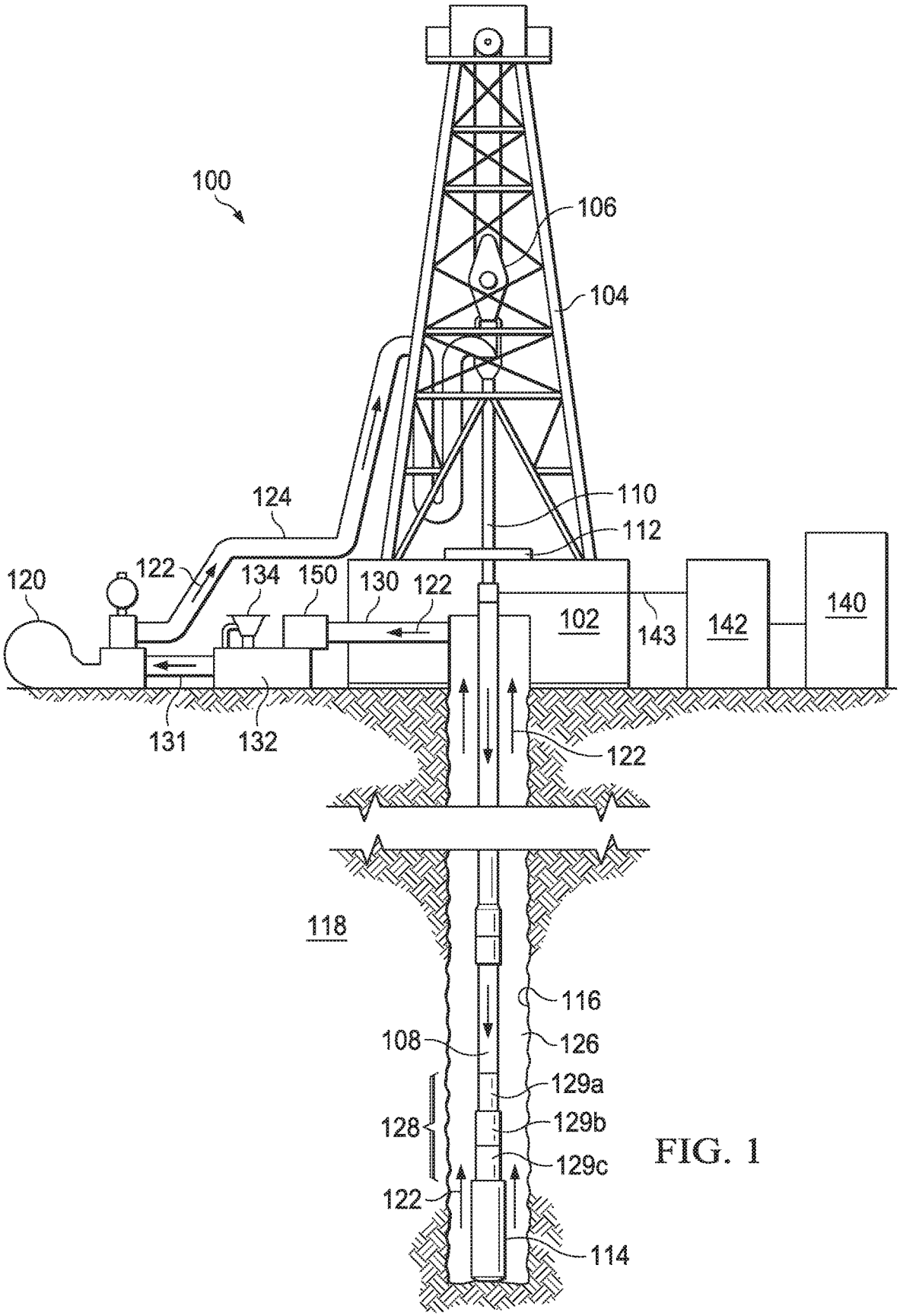
FIG. 1 is an elevation view of an exemplary pulsed-power drilling system used to form a wellbore in a subterranean formation.

FIG. 1 is an elevation view of an exemplary pulsed-power drilling system used to form a wellbore in a subterranean formation. Although FIG. 1 shows land-based equipment, downhole tools incorporating teachings of the present disclosure may be satisfactorily used with equipment located on offshore platforms, drill ships, semi-submersibles, and drilling barges (not expressly shown). Similarly, although an exemplary pulsed-power drilling system is described in FIG. 1, the methods and devices could be used with conventional drilling systems, for example rotary systems using diamond or roller cone drill bits, to manage the health of a conventional drilling fluid. Additionally, while wellbore 116 is shown as being a generally vertical wellbore, wellbore 116 may be any orientation including generally horizontal, multilateral, or directional.

Pulsed-power drilling system 100 includes drilling platform 102 that supports derrick 104 having traveling block 106, or other draw-works, for raising and lowering drill string 108. Drilling system 100 also includes pump 120, which circulates pulsed-power drilling fluid 122 (also called "mud") through feed pipe 124 to kelly 110, which in turn conveys pulsed-power drilling fluid 122 downhole through interior channels of drill string 108 and through pulsed-power drill bit 114. Pulsed-power drilling fluid 122 circulates back to the surface via annulus 126 formed between drill string 108 and the sidewalls of wellbore 116. Fractured portions of the formation (also called "cuttings") are carried to the surface by drilling fluid 122 to remove those fractured portions from wellbore 116.

Pulsed-power drill bit 114 is attached to the downhole end of drill string 108 and may be an electrocrushing drill bit or an electrohydraulic drill bit. Power may be supplied to drill bit 114 from components downhole, components at the surface and/or a combination of components downhole and at the surface. For example, generator 140 may generate electrical power and provide power to power-conditioning unit 142. Power-conditioning unit 142 may then transmit electrical energy downhole via surface cable 143 and a sub-surface cable (not expressly shown in FIG. 1) contained within or otherwise attached to drill string 108. A pulse-generating circuit within bottom-hole assembly (BHA) 128, for example within a bottom-hole subassembly 129*a*, 129*b*, or 129*c*, may receive the electrical energy from power-conditioning unit 142, and may generate high-energy pulses to drive pulsed-power drill bit 114.

BHA 128 may include a wide variety of bottom-hole subassemblies configured to form wellbore 116. For example, subassemblies 129*a*, 129*b*, and 129*c* of BHA 128 may include, but are not limited to, drill bits (e.g., drill bit 114), steering tools, directional drilling tools, downhole generators, and/or the downhole mixers that are the subject of the present disclosure. BHA 128 may also include various types of well logging tools and other downhole tools, for example as subassemblies. A specific subassembly, such as a downhole mixer, may be included as any one of subassemblies 129*a*, 129*b*, or 129*c* within BHA 128. While multiple subassemblies are shown, BHA 128 may alternatively include a single assembly.

Downhole mixer may be positioned such that the optimal electrical properties (e.g., high dielectric constant, high dielectric strength, and low electric conductivity) of pulsed-power drilling fluid may be restored proximate to drill bit 114, where the optimal electrical properties are used to create an electrical arc into a rock formation. For example, downhole mixer may be positioned within subassembly 129*c* of BHA 128 to restore a high dielectric constant of the pulsed-power drilling fluid prior to exiting the drill bit 114. Restoring the optimal electrical properties of the pulsed-power drilling fluid proximate to drill bit 114 may be advantageous in that the dielectric constant is increased efficiently, passing through a single downhole mixer before exiting proximate to its point of use. Similarly, downhole mixer may be positioned within any, or all, of subassemblies 129*a*, 129*b*, and/or 129*c* such that optimal electrical properties of the pulsed-power drilling fluid may be restored within wellbore 116.

Pulsed-power drilling system 100 may include multiple downhole mixers that work in tandem via successive subassemblies to restore optimal electrical properties in the pulsed-power drilling fluid. For example, several downhole mixers may be located within subassemblies positioned along the length of the drill string 108 such that pulsed-power drilling fluid is mixed (e.g., maintaining optimal electrical properties) as it is conveyed downhole through a channel of drill string 108 toward drill bit 114. This may be advantageous if maintaining a consistent mixture of optimal electrical properties is desired throughout the length of the drill string 108, or a subset thereof, or if a particular emulsified mixture of pulsed-power drilling fluid requires more than a single pass through a downhole mixer to maintain its stability and thereby deliver optimum electrical performance.

Pulsed-power technology may be utilized to repeatedly apply a high electric potential, for example up to or exceeding 150 kV, across the electrodes of pulsed-power drill bit 114. Each application of electric potential is referred to as a pulse. The high-energy electrical pulses generated by the pulse-generating circuit may be referred to as pulse drilling signals. When the electric potential across the electrodes of pulsed-power drill bit 114, for example an electrocrushing drill bit, is increased enough during a pulse to generate a sufficiently high electric field, an electrical arc forms through a rock formation at the bottom of wellbore 116. The arc temporarily forms an electrical coupling between the electrodes, allowing electric current to flow through the arc inside a portion of the rock formation at the bottom of wellbore 116. The arc greatly increases the temperature and pressure of the portion of the rock formation through which the arc flows and the surrounding formation and materials. The temperature and pressure are sufficiently high to break the rock itself into small bits or cuttings. This fractured rock is removed, typically by drilling fluid 122, which moves the fractured rock away from the electrodes and uphole. The terms "uphole" and "downhole" may be used to describe the location of various components of pulsed-power drilling system 100 relative to drill bit 114 or relative to the distal end of wellbore 116 shown in FIG. 1. For example, a first component described as uphole from a second component may be further away from drill bit 114 and/or the distal end of wellbore 116 than the second component. Similarly, a first component described as being downhole from a second component may be located closer to drill bit 114 and/or the distal end of wellbore 116 than the second component.

As pulsed-power drill bit 114 repeatedly fractures rock and pulsed-power drilling fluid 122 moves the fractured rock uphole, wellbore 116, which penetrates various subterranean rock formations 118, is created. Wellbore 116 may be any hole drilled into a subterranean formation or series of subterranean formations for the purpose of exploration or extraction of natural resources such as, for example, hydrocarbons, or for the purpose of injection of fluids such as, for example, water, wastewater, brine, or water mixed with other fluids. Additionally, wellbore 116 may be any hole drilled into a subterranean formation or series of subterranean formations for the purpose of geothermal power generation, or any other purpose.

Although pulsed-power drill bit 114 is described above as implementing electrocrushing drilling, pulsed-power drill bit 114 may also be used for electrohydraulic drilling. In electrohydraulic drilling, rather than generating an electrical arc within the rock, drill bit 114 applies a large electrical potential across the one or more electrodes to form an arc across the drilling fluid proximate to the distal end of wellbore 116. The high temperature of the arc vaporizes the portion of the drilling fluid immediately surrounding the arc, which in turn generates a high-energy shock wave in the remaining fluid. The electrodes of electrohydraulic drill bit may be oriented such that the shock wave generated by the arc is transmitted toward the distal end of wellbore 116. When the shock wave contacts and bounces off of the rock at the distal end of wellbore 116, the rock fractures. Accordingly, wellbore 116 may be formed in subterranean formation 118 using drill bit 114 that implements either electrocrushing or electrohydraulic drilling. The circuit topologies used for electrohydraulic drilling may be the same as, or similar to, those used for electrocrushing drilling with at least some components of the circuits having different values.

Figure 2:
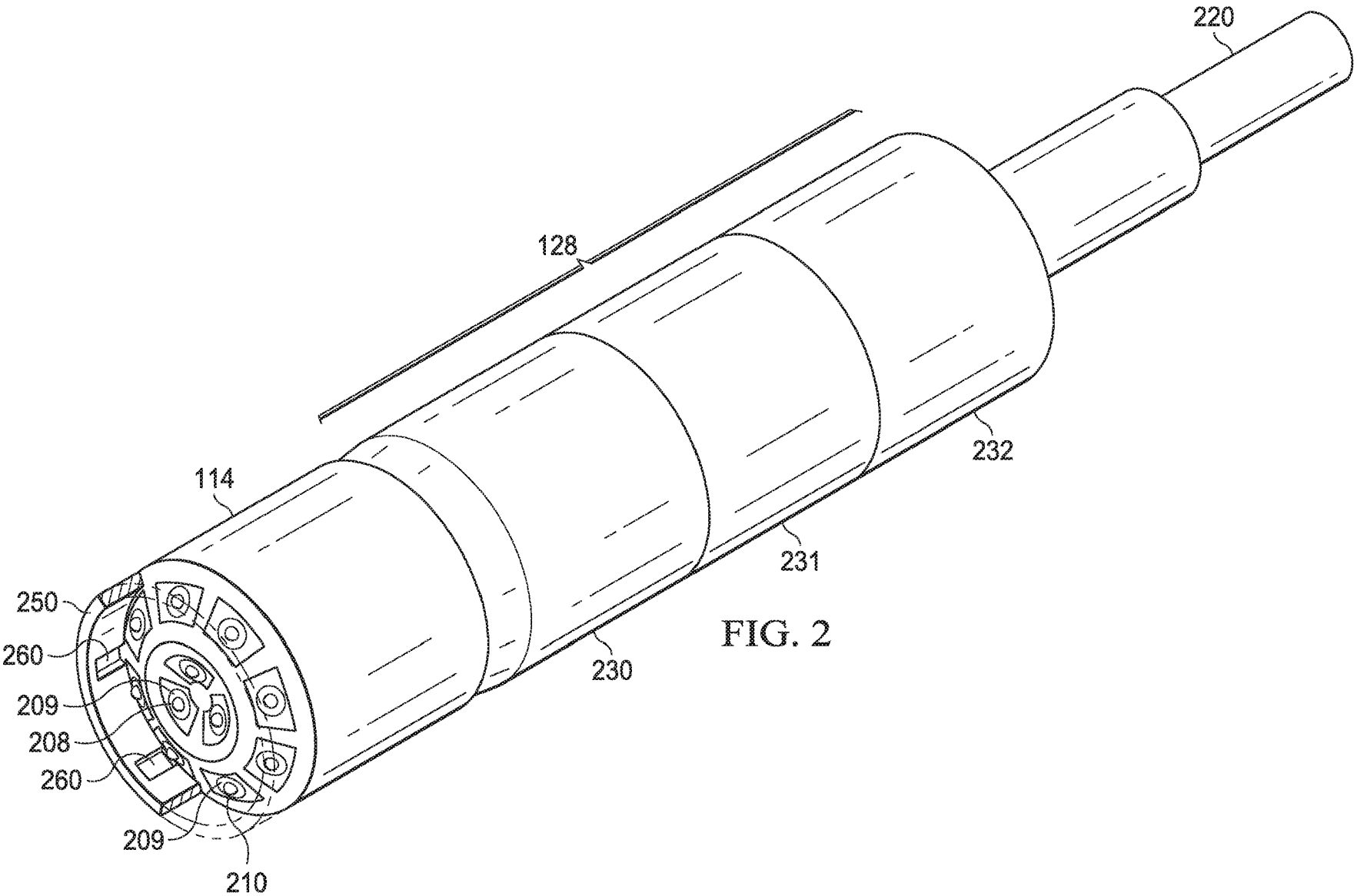
FIG. 2 is a perspective view of exemplary components of a bottom-hole assembly for a downhole pulsed-power drilling system.

FIG. 2 is a perspective view of exemplary components of a BHA for pulsed-power drilling system 100. As described with reference to FIG. 1 above, BHA 128 may include various subassemblies. For example, BHA 128 may include downhole mixer 230, instrumentation module 231, and pulsed-power tool 232. Although the subassemblies could be arranged in any order within BHA 128. BHA 128 may also include pulsed-power drill bit 114. For the purposes of the present disclosure, pulsed-power drill bit 114 may be referred to as being integrated within BHA 128, or may be referred to as a separate component that is coupled to a subassembly of BHA 128, for example to downhole mixer 230.

Pulsed-power tool 232 may provide pulsed power to pulsed-power drill bit 114. Pulsed-power tool 232 receives electrical energy from a power source via cable 220. For example, pulsed-power tool 232 may receive power via cable 220 from a power source on the surface as described above with reference to FIG. 1, or from a power source located downhole such as a generator powered by a mud turbine. Pulsed-power tool 232 may also receive power via a combination of a power source on the surface and a power source located downhole. Pulsed-power tool 232 converts the electrical energy received from the power source into high-power electrical pulses and may apply those high-power pulses across electrodes of pulsed-power drill bit 114. For the purposes of the present disclosure, ground ring 250 may also be referred to generally as an electrode or more specifically as a ground electrode. In one example, pulsed-power tool 232 may apply the high-power pulses across electrode 208 and ground ring 250 of electrocrushing drill bit 114. Pulsed-power tool 232 may also apply high-power pulses across electrode 210 and ground ring 250 in a similar manner as described herein for electrode 208 and ground ring 250.

Pulsed-power tool 232 may include a pulse-generating circuit. Such a pulse-generating circuit may include high-power capacitors and may include fuse-protection.

Referring to FIGS. 1 and 2, pulsed-power drilling fluid 122 may exit drill string 108 via openings 209 surrounding each electrode 208 and each electrode 210. The flow of pulsed-power drill fluid 122 out of openings 209 allows electrodes 208 and 210 to be insulated by the pulsed-power drilling fluid. In some embodiments, pulsed-power drill bit 114 may include a solid insulator (not expressly shown in FIG. 1 or 2) surrounding electrodes 208 and 210 and one or more openings (not expressly shown in FIG. 1 or 2) on the face of pulsed-power drill bit 114 through which pulsed-power drilling fluid 122 may exit drill string 108. Because fines are not typically generated during pulsed-power drilling, as opposed to mechanical drilling, pulsed-power drilling fluid 122 may not need to exit the drill bit at as high a pressure as the drilling fluid in mechanical drilling. As a result, nozzles and other features used to increase drilling fluid pressure may not be needed. However, nozzles or other features to increase pulsed-power drilling fluid 122 pressure or to direct pulsed-power drilling fluid 122 may be included for some uses.

Drilling fluid 122 is typically circulated through drilling system 100 at a flow rate sufficient to remove fractured rock from the vicinity of pulsed-power drill bit 114 in sufficient quantities within a sufficient time to allow the drilling operation to proceed downhole at least at a minimum set rate. In addition, pulsed-power drilling fluid 122 may be under sufficient pressure at a location in wellbore 116, particularly a location near a hydrocarbon, gas, water, or other deposit, to prevent a blowout. Pulsed-power drilling fluid 122 may also be circulated at a flow rate sufficient to remove vaporization and cavitation bubbles from the vicinity of pulsed-power drill bit 114.

In addition, pulsed-power drill bit 114 may include ground ring 250, shown in part in FIG. 2. Although not all pulsed-power drill bits 114 may have ground ring 250, if it is present, it may contain passages 260 to permit the flow of pulsed-power drilling fluid 122 along with any fractured rock or bubbles away from electrodes 208 and 210 and uphole.

Referring again to FIG. 1, recirculated or spent pulsed-power drilling fluid 122 exits annulus 126 at the surface and may be directed back into drill string 108 or may otherwise be processed using some of the equipment shown in FIG. 1. For example, pulsed-power drilling fluid 122 may be processed by conveying the fluid to one or more fluid processing units 150 via an interconnecting flow line 130. After passing through fluid processing units 150, cleaned pulsed-power drilling fluid 122 is deposited into retention pit 132. Although fluid processing unit 150 is illustrated in FIG. 1 near the outlet of the wellbore 116, fluid processing unit 150 may be located at a distance from the outlet of wellbore 116.

Drilling system 100 may further include mixing hopper 134 communicably coupled to or otherwise in fluidic communication with retention pit 132. Mixing hopper 134 may include, but is not limited to, additive mixers and related additive mixing equipment that may be used to introduce additives to pulsed-power drilling fluid 122.

To limit discharge of the electric field through pulsed-power drilling fluid 122 and allow more electrical current to flow into the rock at the downhole end of wellbore 116, an electrically insulating pulsed-power drilling fluid 122 with a high dielectric constant and a high dielectric strength at a particular operating frequency may be used. An electrically insulating pulsed-power drilling fluid 122 restricts the movement of electrical charges, and therefore, the flow of electrical current through the pulsed-power drilling fluid 122. A fluid with high dielectric constant and high dielectric strength, however, decreases electrical discharge through pulsed-power drilling fluid 122. The dielectric constant of the downhole fluid indicates the ability of the pulsed-power drilling fluid to store electrical energy when exposed to an electric field, such as the potential created by pulsed-power drill bit 114, while the dielectric strength of the downhole fluid indicates a voltage level to which pulsed-power drilling fluid 122 may be exposed before experiencing electrical breakdown, or a loss of its electrically insulating properties.

Pulsed-power drilling fluid 122 may be formulated to have, for example:

i) a set dielectric constant, such as at least 6, at least 10, at least 12, or at least 13 (at 100 kHz frequency), ii) a set dielectric strength, such as at least 100 kV/cm, at least 150 kV/cm, or at least 330 kV/cm (at 10 microseconds rise time), iii) a set electric conductivity, such as less than $10^{-4}$ mho/cm, or less than $10^{-5}$ mho/cm, or any combinations thereof.

Pulsed-power drilling fluids are typically complex emulsified mixtures of various components that have different physical and electrical properties. Such emulsified mixtures may not be stable, and the emulsified components tend to separate and agglomerate when the fluid is under insufficient shear stress. Shearing the fluid causes mixing and improves the quality of the emulsion by more uniformly dispersing the components.

Pulsed-power drilling fluid 122 includes a pulsed-power drilling base fluid and may include one or more additives. Generally, the pulsed-power drilling base fluid may be present in an amount sufficient to form a pumpable pulsed-power drilling fluid. By way of example, the pulsed-power drilling base fluid may be present in pulsed-power drilling fluid 122 in an amount in the range of from 20% to 99.99% by volume of pulsed-power drilling fluid 122. One example of a pulsed-power drilling base fluid includes a non-polar oil, water, glycerin, or any combinations thereof to yield an emulsion formulated in order to deliver the properties required for pulsed-power drilling.

Non-polar oils typically have a high dielectric strength and a low electric conductivity, making them suitable for use in pulsed-power drilling base fluids. However, non-polar oils have a low dielectric constant and may be included with other components with a higher dielectric constant in a pulsed-power drilling base fluid. Combinations of polar oils and non-polar oils may also be used.

The pulsed-power drilling base fluid also may contain water. Water has a low viscosity and a high dielectric constant, but it also has a high electric conductivity, thus potentially limiting its proportional volume in a pulsed-power drilling fluid or base fluid. The electric conductivity of water further increases if salts are dissolved in the water, a frequent occurrence during drilling.

Water also has a highly temperature-variable dielectric constant that decreases with temperature and which may also limit water's proportional volume in a pulsed-power drilling fluid or base fluid because the pulsed-power drilling fluid typically experiences high temperatures in the vicinity of the pulsed-power drill bit.

Polar oils alone tend to have dielectric constants that are too low for pulsed-power drilling. As a result, an alkylene carbonate may be added to the pulsed-power drilling fluid or base fluid, particularly if the fluid contains a polar oil, to the improve these properties because alkylene carbonates have a high dielectric constant and moderate dielectric strength. However, the amount of alkylene carbonate in the pulsed-power drilling base oil may be limited by their electric conductivity. In particular, alkylene carbonate can react with water which may cause the alkylene carbonate to be broken down or destroyed, thereby dramatically reducing its dielectric constant. This reaction may be compounded at high temperatures (e.g., such as those associated with pulsed-power drilling).

The pulsed-power drilling fluid or base fluid may further include glycerin. Glycerin has a high dielectric constant and low electric conductivity, but also low dielectric strength, thus potentially limiting its proportional volume in a pulsed-power drilling fluid or base fluid.

Glycerin, water, and non-polar oil may be mixed in any order. However, pulsed-power drilling base fluids containing a mixture of polar oil and alkylene carbonate along with glycerin, water, non-polar oil, or any combination thereof may exhibit different electrical properties depending on the order in which components are mixed and/or on the fineness of emulsion droplets dispersed within the emulsified mixture.

One or more electrical additives may change one or more electrical properties of the pulsed-power drilling base fluid. For instance, an electrical additive may change a dielectric property of the pulsed-power drilling base fluid. Such additives may include mica in any of its various forms, polytetrafluoroethylene, other chemical variants of tetrafluoroethylene, glass or a composition of glass. The electrical additive may be present in a pulsed-power drilling fluid in an amount sufficient for a particular drilling system, formation, or combination thereof. The type of electrical additive or combination of electrical additives in a pulsed-power drilling fluid may also be based at least partially upon a particular drilling system, formation, or combination thereof.

The pulsed-power drilling fluid may further include additives used in conventional drilling fluids. These additives may provide properties to the pulsed-power drilling fluid similar to the properties they provide to conventional drilling fluids. However, some additives used in conventional drilling fluids may not be suitable for a pulsed-power drilling fluid due to their effects on electrical properties, such as dielectric constant, dielectric strength, or electric conductivity, or because they are not compatible with a pulsed-power drill bit.

Additives may include a lost circulation prevention material, such as a bridging material or a fluid loss control agent, a rheology modifier, such as a viscosifier or a thinner, a weighting agent, a solid wetting agent, an acid or $H_2S$ scavenger, a lubricant, other additives, and any combinations thereof.

Rheology modifiers change the flow properties of the pulsed-power drilling fluid. Rheology modifiers may, for instance, change the shear properties or viscosity of the drilling fluid. The rheology modifier may be present in the pulsed-power drilling fluid in an amount sufficient for a particular drilling system, formation, or combination thereof. The type of rheology modifier or combination of rheology modifiers in the pulsed-power drilling fluid may also be based at least partially upon a particular drilling system, formation, or combination thereof.

Thinners are a type of rheology modifier that decrease the viscosity of a drilling fluid. In drilling fluids that experience flocculation, such as drilling fluids containing some clays, thinners may also be deflocculants. Pulsed-power drilling may benefit from a low viscosity drilling fluid, such that thinners may be a particularly useful additive.

Viscosifiers increase the viscosity of a drilling fluid. A viscosifier may be used in the drilling fluid to impart a sufficient carrying capacity or thixoropy or both to the drilling fluid, enabling the drilling fluid to transport and prevent settling of fractured rock or weighting materials, or both.

Emulsifiers help create a mixture of two immiscible liquids, such as an oil-based liquid and an aqueous liquid. Suitable emulsifiers include polyaminated fatty acids. Pulsed-power drilling fluid 122 is preferably an invert emulsion and thus may particularly benefit from an emulsifier. The emulsifier may be present in pulsed-power drilling fluid 122 in an amount sufficient for a particular drilling system, formation, or combination thereof. The type of emulsifier or combination of emulsifier in pulsed-power drilling fluid 122 may also be based at least partially upon the immiscible components of pulsed-power drilling fluid 122, a particular drilling system, formation, or combination thereof.

Weighting agents increase the density of a pulsed-power drilling fluid without being dissolved in it. Suitable weighting agents include barite, hematite, ilmenite, manganese tetraoxide, and any combinations thereof.

Other additives may also be used. These may include corrosion inhibitors, defoamers, shale stabilizers, lubricants, wetting agents, dispersing agents, shale inhibitors, pH-control agents, filtration-control agents, alkalinity sources such as lime and calcium hydroxide, salts, foamers, viscosifiers, thinners, deflocculents, or any combinations thereof.

Drilling fluid 122, therefore, may be a complex emulsified mixture of various components and additives that affect the physical and electrical properties of the drilling fluid. An emulsion is typically a stable or semi-stable mixture of two or more immiscible or insoluble liquids. For example, in an emulsion of two such liquids, one liquid is dispersed, and preferably uniformly dispersed, in the other, typically in the form of small droplets or particles. As used herein, the term emulsion can also include colloidal mixtures that include other insoluble particles. The quality of an emulsion may refer to how uniformly the components of an emulsion are dispersed within the emulsified mixture.

As discussed above, pulsed-power drilling fluid 122 may not be a stable emulsified mixture. The internal structure of an emulsion, such as pulsed-power drilling fluid 122, may change with time or with the level of shear stress in the drilling fluid. For example, the components of the mixture may separate and agglomerate. In particular, the size of emulsified droplets within the mixture may increase such that solids may settle to the bottom of the mixture. This may cause changes to the internal structure of drilling fluid 122 that can significantly affect the physical and electrical properties of drilling fluid 122. Specifically, the dielectric constant of drilling fluid 122 can decrease such that it is insufficient for pulsed-power drilling operations. For example, if drilling fluid 122 remains stagnant or experiences laminar flow, drilling fluid 122 may not receive adequate shear stress to maintain emulsion stability which can decrease the dielectric constant of drilling fluid 122.

The electrical properties of the emulsified mixture of drilling fluid 122 may be managed in a number of ways. One method involves adjusting the chemistry of the mixture by introducing various additives, as described above, through mixing hopper 134. Another method, which is the subject of the present disclosure, involves using a downhole mixer that includes flow restrictors, baffles or a combination of flow restrictors and baffles disposed in a channel to mix drilling fluid 122 by shearing the fluid. Restricting the flow of drilling fluid 122 in this manner increases the frictional forces acting on the fluid and thus increases the shear stress in the fluid. Shear stress in the fluid tends to separate emulsion components that have agglomerated and mix the fluid to more uniformly distribute the components of the emulsion thus improving the emulsion quality. For example, shear stress may break up large emulsion droplets that have aggregated, combined, and/or coalesced. The level of shear stress is sufficient if it breaks-up components of the emulsified mixture that have agglomerated and more uniformly disperses the components of the emulsified mixture to improve the quality of the emulsion so that the electrical properties, for example the dielectric constant, are managed at a level sufficient to sustain drilling operations.

The level of shear stress that the downhole mixer generates in drilling fluid 122 may be characterized or approximated, in a relative manner, by the pressure drop (also referred to as a pressure differential) across the downhole mixer. Greater pressure differentials may indicate a greater amount of shear stress and a correspondingly greater amount of mixing. As described in detail below, the downhole mixer may include one or more flow restrictors, one or more baffles or a combination of one or more flow restrictors and one or more baffles. The pressure differential across a flow restrictor or a baffle can be determined using known fluid mechanics methods and is generally dependent on the on the geometry of the flow restrictor or baffle, as well as the fluid properties and flow parameters of the drilling fluid. The downhole mixers described below may be designed to create a pressure differential of preferably at least 100 pounds per square inch gauge (psig), or more preferably at least 250 psig, or most preferably at least 500 psig during normal pulsed-power drilling operations. Alternatively, the pressure differential may be expressed as a percentage of the normal operating pressure or the maximum operating pressure. For example, in some embodiments, pump 120 may have a maximum operating pressure of about 5,000 psig. In some embodiments, it may be preferable for downhole mixers described below to create a pressure differential of up to 50% of the maximum operating pressure.

Figure 3:
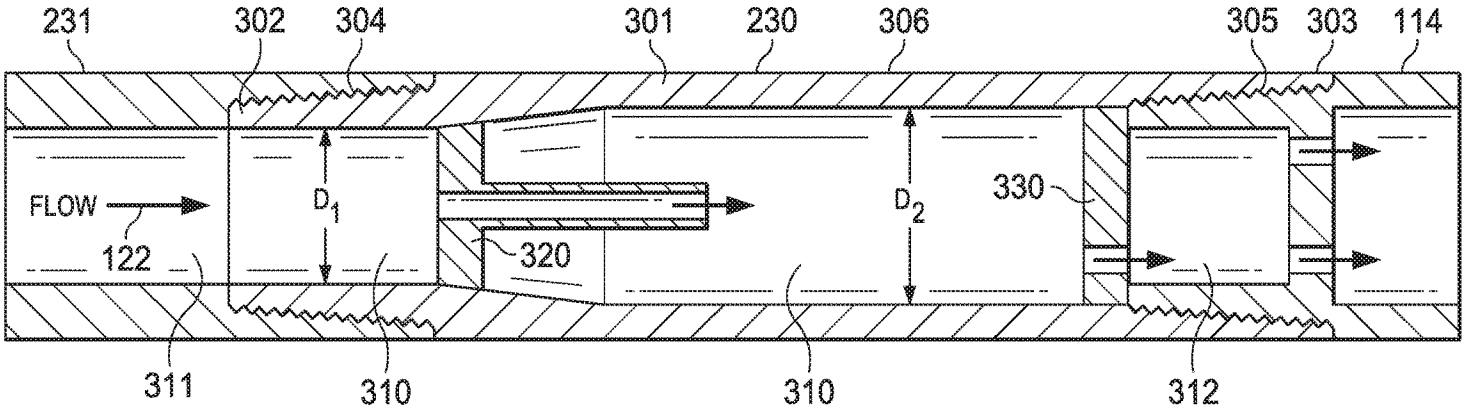
FIG. 3 is a cross-sectional view of a downhole mixer that includes two flow restrictors for managing the electrical properties of a pulsed-power drilling fluid.

FIG. 3 is a cross-sectional view of a downhole mixer that includes two flow restrictors for managing the electrical properties of a pulsed-power drilling fluid. Housing 301 may be coupled to bottom-hole subassembly 231 proximate uphole end 302 and may be coupled to drill bit 114 proximate downhole end 303. Housing 301 may include threads 304 to couple downhole mixer 230 to bottom-hole subassembly 231 and threads 305 to couple downhole mixer 230 to drill bit 114. However, other suitable connections can be used.

Because bottom-hole subassembly 231 may be cylindrical in shape, outer surface 306 of housing 301 may be cylindrical as well. However, other geometries can be used. Housing 301 may be formed using known casting, welding, and machining techniques. Housing 301 may be made from a steel material, for example grade 4140 steel. However, housing 301 may be made from any material suitable for use in a pulsed-power BHA.

Channel 310 is formed within housing 301 and defines a path for drilling fluid 122 to flow through housing 301. Channel 310 has entrance 311 proximate uphole end 302 and exit 312 proximate downhole end 303. Channel 310 may have an inner diameter, indicated as dimension $D_1$, proximate entrance 311 that is different from an inner diameter, indicated as dimension $D_2$, proximate exit 312. Inner diameter $D_2$ may be larger than inner diameter $D_1$. However, inner diameter $D_1$ could be equal to inner diameter $D_2$, or inner diameter $D_1$ could be larger than inner diameter $D_2$.

Flow restrictor 320 is positioned within channel 310, between entrance 311 and exit 312, and partially restricts the flow of drilling fluid 122 through housing 301. Flow restrictor 320 may be an elongational flow orifice type flow restrictor having a fixed diameter, as shown. However, it could be any of several types of flow restrictors including, but not limited to, an orifice plate having one or more orifices with fixed diameters. Additionally, flow restrictor 330 may be positioned within channel 310 to further partially restrict the flow of drilling fluid 122 through housing 301. Flow restrictor 330 may be an orifice plate type flow restrictor including one or more orifices having a fixed diameter, as shown. The fixed diameter of each orifice included on the orifice plate type flow restrictor may have a same, larger, or smaller diameter from the fixed diameter of other orifices included on the orifice plate type flow restrictor.

Flow restrictors 320 and 330 may be stationary with respect to the housing during drilling operations. Flow restrictors 320 and 330 may by integrally formed with the housing, or they may be coupled to the housing using threaded connections or other mechanical connections. Preferably, flow restrictors 320 and 330 are replaceable due to the abrasive nature of drilling fluid 122.

Figure 4:
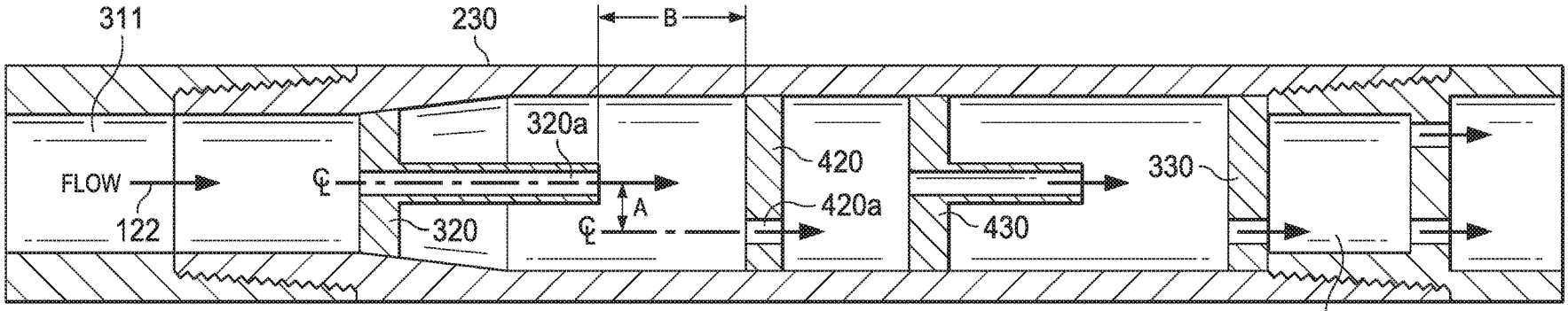
FIG. 4 is a cross-sectional view of a downhole mixer that includes four flow restrictors for managing the electrical properties of a pulsed-power drilling fluid.

FIG. 4 is a cross-sectional view of a downhole mixer that includes four flow restrictors for managing the electrical properties of drilling fluid 122. Downhole mixer 230 may include flow restrictor 420, shown as an orifice plate type flow restrictor including one ore more orifices having a fixed diameter, and flow restrictor 430, shown as an elongational flow orifice type flow restrictor including an orifice having a fixed diameter. However, it should be recognized that flow restrictors 420 and 430 may be any type of flow restrictor suitable for sufficiently increasing the shear stress in drilling fluid 122, such that the emulsion quality, and thereby the electrical properties, of drilling fluid 122 are managed and maintained at levels sufficient to sustain drilling operations, as described above. For example, other such flow restrictors may include converging and/or diverging nozzles.

Where a plurality of flow restrictors are used, for example as shown in FIGS. 3 and 4, the plurality of flow restrictors may be arranged as shown in FIGS. 3 and 4. However, it should be recognized that the plurality of flow restrictors may be arranged in any number of configurations, which are designed to manage the electrical properties of drilling fluid 122 and to control the pressure drop between entrance 311 and exit 312 of downhole mixer 230. Additionally, greater or fewer numbers of flow restrictors may be used.

In FIG. 4, for example, flow restrictor 320 is shown as an elongational flow orifice type flow restrictor that is followed downstream, as indicated by the arrows showing the normal direction of flow of drilling fluid 122 during drilling operations, by flow restrictor 420, shown as an orifice plate type flow restrictor. Flow restrictor 420 is followed downstream by flow restrictors 430 and 330.

The relative positions of each flow restrictor may be designed to maximize the shear stress in drilling fluid 122. For example, the position of flow restrictor 420, shown as an orifice plate having orifice 420*a*, relative to flow restrictor 320, shown as an elongational flow orifice having orifice 320*a*, may be designed to ensure that orifices 320*a* and 420*a* are not co-linear, such that the centerline of orifice 320*a* is offset from the centerline of orifice 420*a* by a specified amount, as indicated by dimension A. Such an offset may increase the shear stress in drilling fluid 122 by forcing the drilling fluid 122 to change directions. Further, the relative distance between flow restrictors 320 and 420, indicated by dimension B, may be designed so that flow restrictor 420, shown as an orifice plate type flow restrictor, effectively acts as an impingement plate, further increasing the shear stress in drilling fluid 122.

Figure 5:
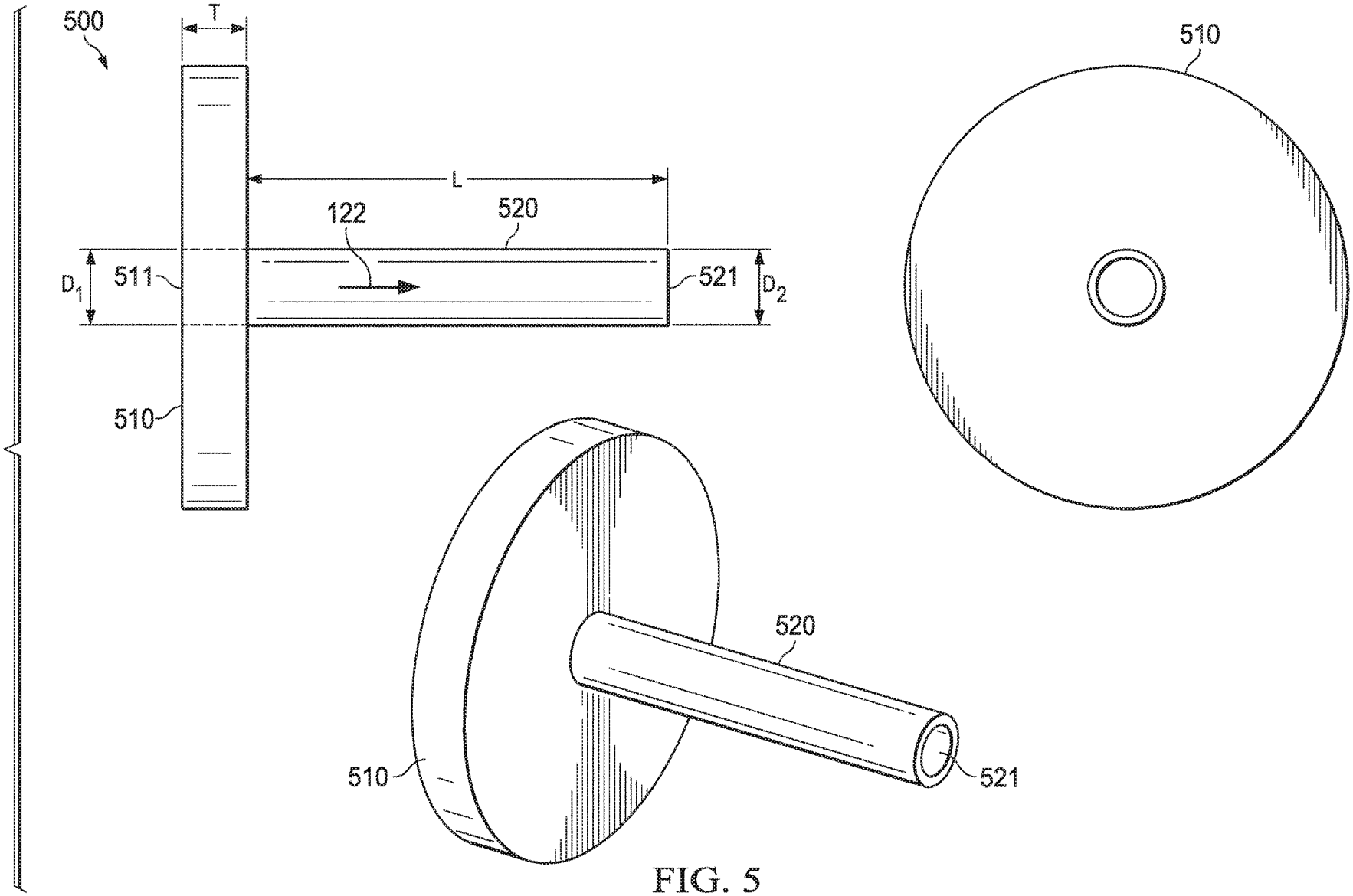
FIG. 5 shows various views of an elongational flow orifice type flow restrictor.

FIG. 5 shows various views of an example elongational flow orifice type flow restrictor 500 that may be used in a downhole mixer, for example as flow restrictors 320 and 430 shown in FIG. 4. Elongational flow orifice 500 may be described as a combination of orifice plate section 510 and elongated nozzle section 520. Elongational flow orifice 500 has entrance 511 and exit 521. Preferably, the fixed diameter of entrance 511, indicated by dimension $D_1$, is equal to the fixed diameter of exit 521, indicated by dimension $D_2$. However, $D_1$ could be greater than $D_2$, such that nozzle section 520 converges toward exit 521. Alternatively, $D_2$ could be greater than $D_1$, such that nozzle section 520 diverges toward exit 521.

Nozzle section 520 has a fixed diameter and is elongated such that it may create elongational flow characteristics in drilling fluid 122 as drilling fluid 122 flows through elongational flow orifice 500. The length of nozzle section 520, indicated as dimension L, is preferably at least 2 times the average inner diameter of nozzle section 520. More preferably the length of nozzle section 520 is at least 4 times the average inner diameter of nozzle section 520. Elongational flow characteristics may include elongational shear stresses due to stretching of the fluid as it flows through elongational flow orifice 500. When drilling fluid 122 is an emulsified mixture, the elongational shear stress can dramatically change the emulsion structure in drilling fluid 122 without changing the component makeup of the mixture. This change in structure may result in improved electrical properties, for example a higher dielectric constant.

Figure 6A:
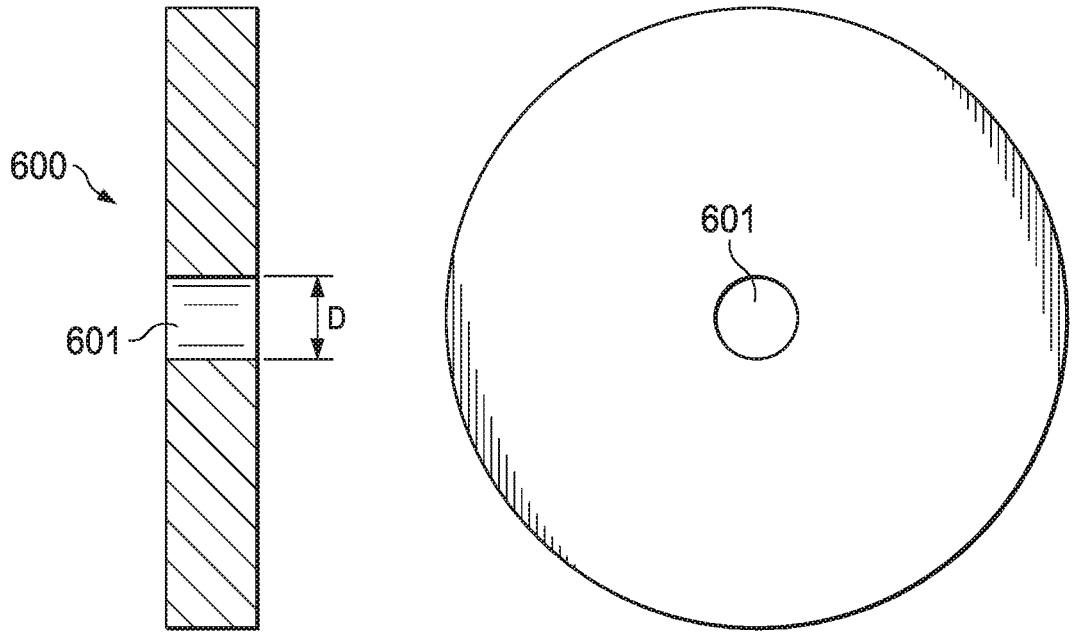
FIG. 6A to 6D show various example embodiments and views of an orifice plate type flow restrictor.

FIGS. 6*a*-6*d* show various example embodiments and views of an orifice plate type flow restrictor. The examples shown in FIGS. 6*a*-6*d* of different orifice plate type flow restrictors may be used in a downhole mixer, for example as flow restrictors 330 and 420 in FIG. 4. FIG. 6*a* shows various views of orifice plate 600 having a single orifice 601 located proximate the center of orifice plate 600. The diameter of orifice 601, indicated by dimension D, is preferably less than 2 inches. More preferably the diameter D of orifice 601 is less than 1 inch.

Figure 6B:
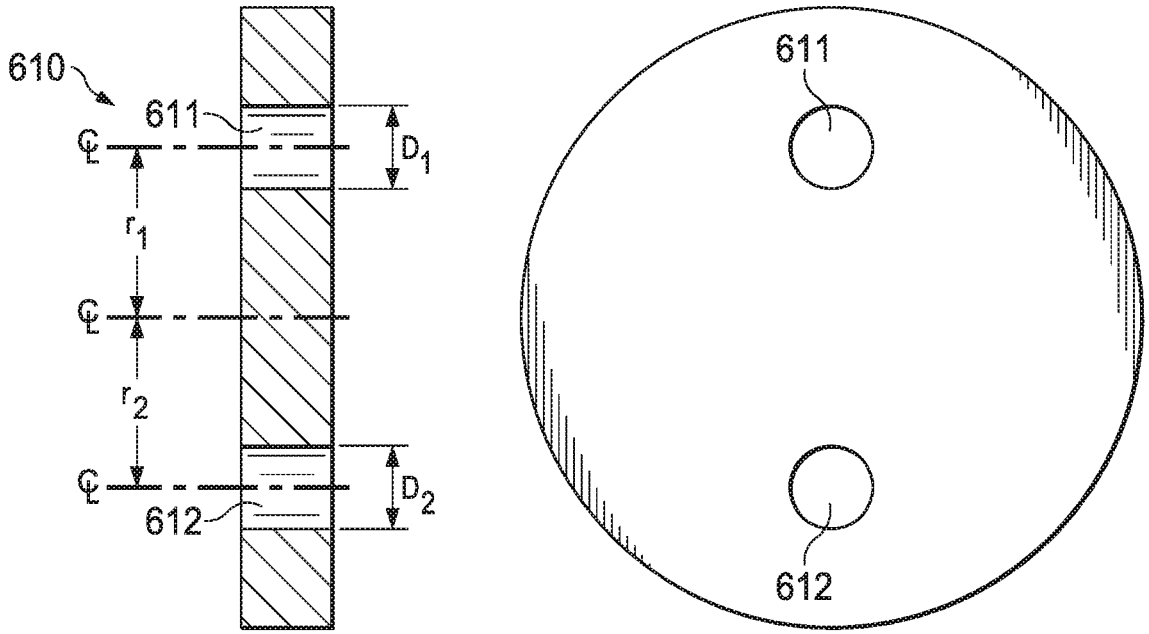

FIG. 6*b* shows various views of orifice plate 610 having orifice 611 and orifice 612. The centerline of orifice 611 may be located at a radius, indicated as dimension $r_1$, from the centerline of orifice plate 610 and may have a diameter, indicated as dimension $D_1$. The centerline of orifice 612 may be located at a radius, indicated as dimension $r_2$, from the centerline of orifice plate 610 and may have a diameter, indicated as dimension $D_2$. Radius $r_1$ may be equal to or different from radius $r_2$. Diameter $D_1$ may be equal to or different from diameter $D_2$. Diameters $D_1$ and $D_2$ are preferably less than 4 inches. More preferably the they are less than 2 inches.

Figure 6C:
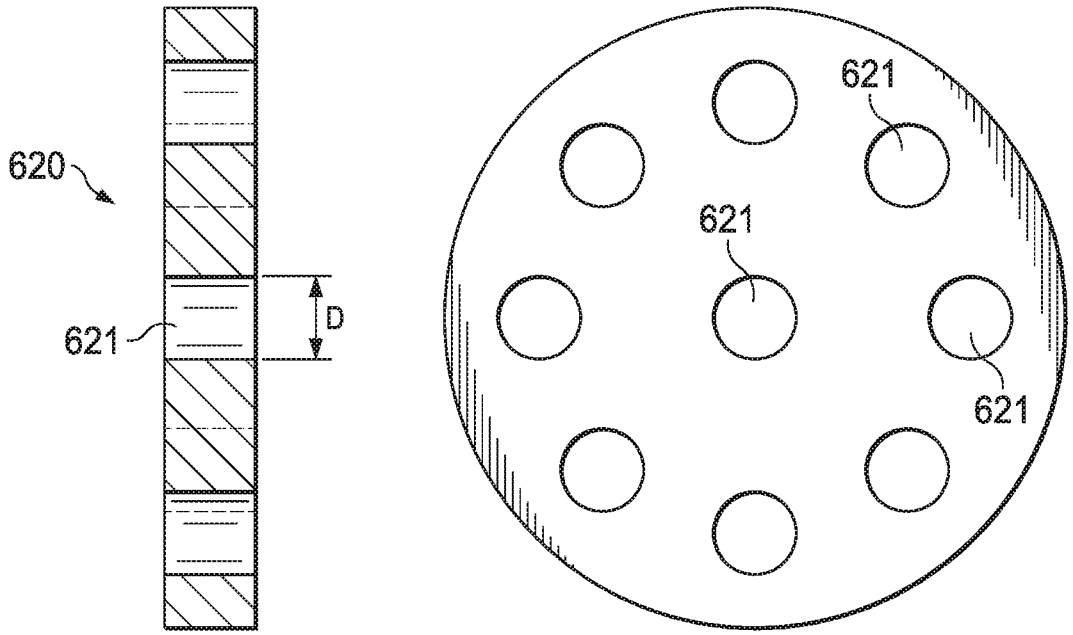

FIG. 6*c* shows various views of orifice plate 620 having many orifices 621 of a fixed diameter. Although nine orifices 621 are shown (not all individually labeled), the number of orifices can be greater or fewer. Orifices 621 may all have the same diameter and may be evenly spaced. In other embodiments, not shown, orifices 621 may have different diameters. In other embodiments, not shown, orifices 621 may be unevenly spaced in orifice plate 620.

Figure 6D:
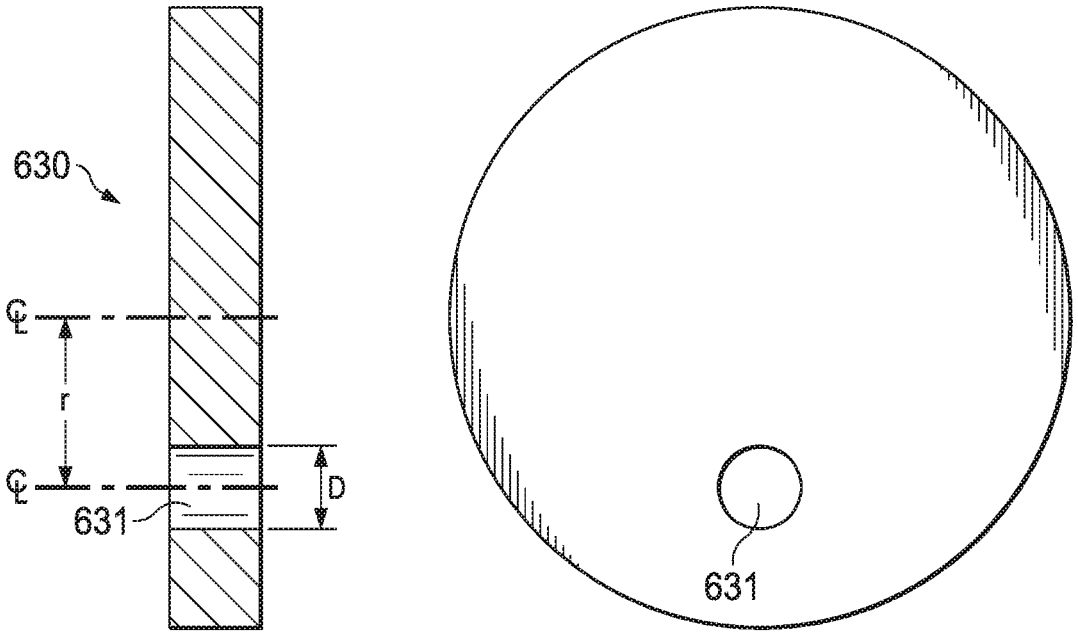

FIG. 6*d* shows various views of orifice plate 630 having orifice 631 located at a position radially offset from the centerline of orifice plate 600, indicated as dimension r. Orifice plate 630 may be used, for example, as flow restrictor 420. Orifice 631 has a diameter, indicated as dimension D, that is preferably less than 4 inches. More preferably the diameter D of orifice 631 is less than 2 inches.

Referring to FIGS. 6*a*-6*d* generally, the sizes and positions of the orifice(s) in each orifice plate may be determined based on a desired pressure drop across the orifice plate that is sufficient to indicate that sufficient shearing of the fluid will occur. The pressure drop across any one of orifice plates 6*a*-6*d* is preferably greater than 10 psig during active drilling operations. The pressure drop across any one of orifice plates 6*a*-6*d* is more preferably greater than 100 psig during active drilling operations. The pressure drop across a downhole mixer containing a plurality of flow restrictors may be determined by summing the pressure drops across each individual flow restrictor.

Figure 7:
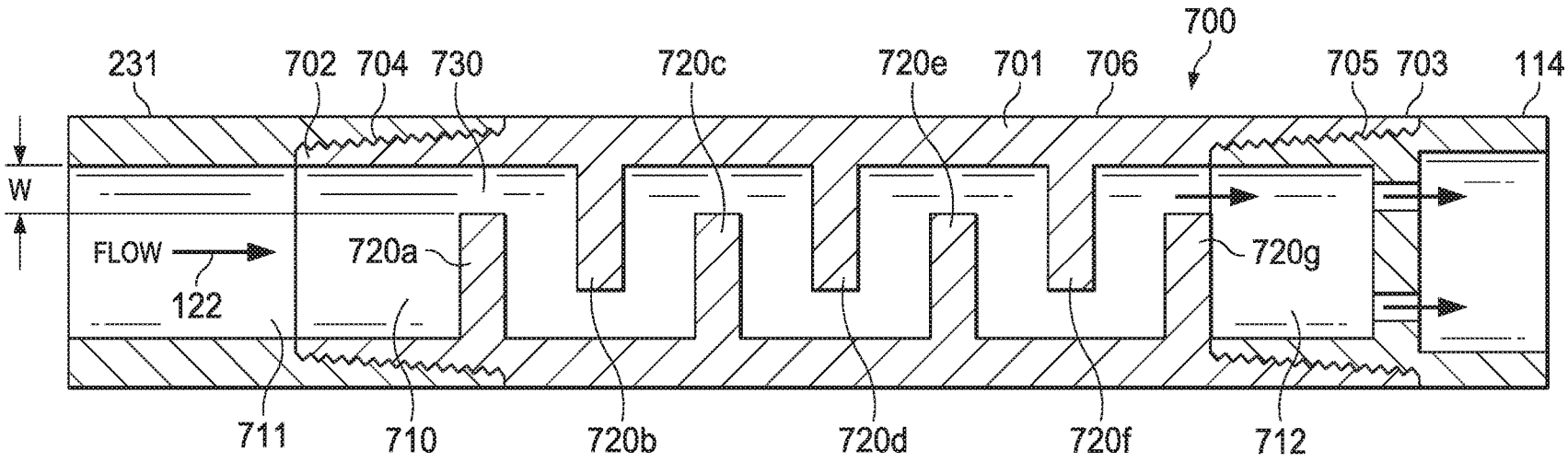
FIG. 7 is a cross-sectional view of a downhole mixer for managing the electrical properties of a pulsed-power drilling fluid comprising evenly spaced baffles positioned within a channel of the downhole mixer.

FIG. 7 is a cross-sectional view of a downhole mixer for managing the electrical properties of drilling fluid 122 comprising evenly spaced baffles positioned within channel 710 of downhole mixer 230. More specifically, evenly spaced baffles are positioned within channel 710 having a constant restricted channel width. In FIG. 7, downhole mixer 230 includes housing 701 having uphole end 702 and downhole end 703. Housing 701 may be coupled to bottomhole subassembly 231 proximate uphole end 702 and may be coupled to drill bit 114 proximate downhole end 703. Housing 701 may include threads 704 to couple downhole mixer 700 to bottom-hole subassembly 231 and threads 705 to couple downhole mixer 700 to drill bit 114. However, other suitable connections may be used.

Because bottom-hole subassembly 231 may be cylindrical in shape, outer surface 706 of housing 701 may be cylindrical as well. However, other geometries can be used. Housing 701 may be formed using known casting, welding, and machining techniques. Housing 701 is preferably made from a steel material, for example grade 4140 steel. However, housing 701 may be made from any material suitable for use in a pulsed-power BHA.

Channel 710 is formed within housing 701 and defines a flow path for drilling fluid 122 to flow through housing 701. Channel 710 has an entrance 711 proximate uphole end 702 and an exit 712 proximate downhole end 703.

Baffle 720*a* is positioned within channel 710, between entrance 711 and exit 712, and partially restricts the flow of drilling fluid 122 through housing 701 similar to the flow restrictors described with respect to FIGS. 1-6 above. Preferably, a series of baffles 720*a*-720*g* are positioned within channel 710, between entrance 711 and exit 712, and partially restrict the flow of drilling fluid 122 through housing 701. More or fewer baffles may be used.

Baffles 720*a*-720*g* may be integrally formed with housing 701 using known casting and/or machining methods. Alternatively, baffles 720*a*-720*g* may be coupled to housing 701. Baffles 720*a*-720*g* preferably have sharp corners, however rounded corners may be used. Baffles 720*a*-720*g* are preferably evenly spaced within housing 701.

Baffles 720*a*-720*g* may be designed to create a restricted channel 730 (also referred to as a tortuous path) within channel 710 through housing 701. This restricted channel 730 may cause a certain percentage (e.g., 90%) of the flow area throughout channel 710 to be periodically interrupted by baffles 720*a*-720*g*. This can increase turbulence in drilling fluid 122 by repeatedly redirecting its flow as it is conveyed through restricted area 720. The width of restricted channel 730, indicated as dimension W, is preferably constant throughout restricted channel 730. Preferably, the width W is less than 3 inches.

Shear stress in drilling fluid 122 is increased as drilling fluid 122 flows through the tortuous path created by restricted channel 730, thereby managing the electrical properties of drilling fluid 122 as described above. Baffles 720*a*-720*g* may be designed to produce a desired pressure differential between entrance 711 and exit 712 during active drilling operations.

Figure 8:
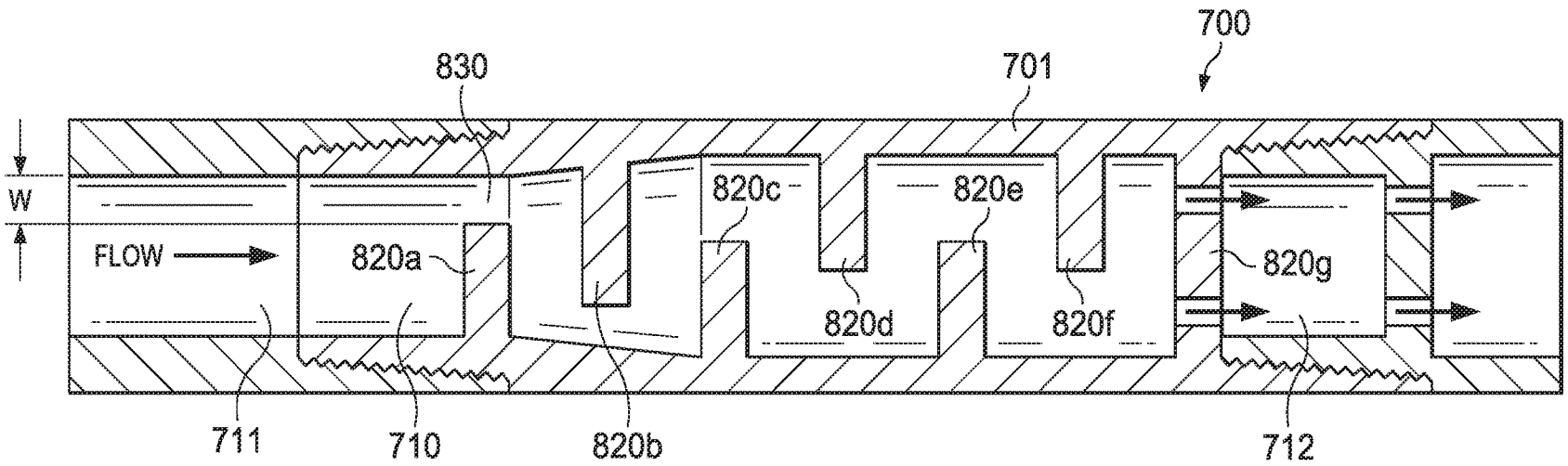
FIG. 8 is a cross-sectional view of a downhole mixer for managing the electrical properties of a pulsed-power drilling fluid comprising unevenly spaced baffles positioned within a channel of the downhole mixer.

FIG. 8 is a cross-sectional view of a downhole mixer for managing the electrical properties of drilling fluid 122 comprising unevenly spaced baffles positioned within channel 710 of downhole mixer 230. More specifically, unevenly spaced baffles are positioned within channel 710 having a variable restricted channel width. In FIG. 8, downhole mixer 700 may alternatively include first baffle 820*a* positioned within channel 710, between entrance 711 and exit 712, and partially restricts the flow of drilling fluid 122 through housing 701 similar to the flow restrictors described with respect to FIGS. 1-6 above. Preferably, a series of baffles 820*a*-820*g* are positioned within channel 710, between entrance 711 and exit 712, and partially restrict the flow of drilling fluid 122 through housing 701. More or fewer baffles may be used.

Baffles 820*a*-820*g* may be integrally formed with housing 701 using known casting and/or machining methods. Alternatively, baffles 820*a*-820*g* may be coupled to housing 701. Baffles 820*a*-820*g* preferably have sharp corners, however rounded corners may be used. Baffles 820*a*-820*g* are preferably unevenly spaced within housing 701.

Baffles 820*a*-820*g* may be designed to create a restricted channel 830 (also referred to as a tortuous path) within channel 710 through housing 701. The width of restricted channel 830, indicated as dimension W, preferably varies throughout restricted channel 830. Preferably, the width W is less than 3 inches at all locations along restricted channel 830.

Shear stress in drilling fluid 122 is increased as drilling fluid 122 flows through the tortuous path created by restricted channel 830, thereby managing the electrical properties of drilling fluid 122 as described above. Baffles 820*a*-820*g* may be designed to produce a desired pressure drop between entrance 711 and exit 712 during active drilling operations.

Downhole mixer 700 may be incorporated as a subassembly in BHA 128 in a similar fashion as downhole 230, as shown in FIG. 2. Generally, the downhole mixer subassembly, for example downhole mixer 230 or 700, may be coupled to drill bit 114, as described above with reference to FIGS. 3 and 7. However, the downhole mixer subassembly may be positioned at different locations in in the BHA. For example, the uphole end could be connected to a subassembly and the downhole end could be connected to another subassembly. Alternatively, the uphole end could be coupled to the drill string and the downhole end could be coupled to another subassembly. In another embodiment, not shown, the downhole mixer subassembly may be the only subassembly in the BHA.

In some embodiments, different types of downhole mixers 700 may be combined to achieve optimal electrical properties (e.g., high dielectric constant, high dielectric strength, and low electric conductivity) of drilling fluid 122. For example, a downhole mixer 700 that creates elongational flow characteristics in drilling fluid 122 as drilling fluid 122 flows through elongational flow orifice 500 may be coupled with a downhole mixer 700 that includes evenly spaced baffles. This coupling can make emulsion droplets of drilling fluid 122 smaller (e.g., via elongational flow) while applying shear stress on drilling fluid 122 (e.g., via the baffles). In some embodiments, any type of flow restrictor and baffles may be both included in a single downhole mixer 700.

As described below with reference to FIG. 9, the downhole mixer may also be positioned at different locations within drilling system 100. In those situations, the ends of the downhole mixer may be formed differently to allow for different methods of coupling the ends to other components of drilling system 100. For example, the ends could include threads, flanges, or a specific weld preparation, such as a J-groove for example.

Figure 9:
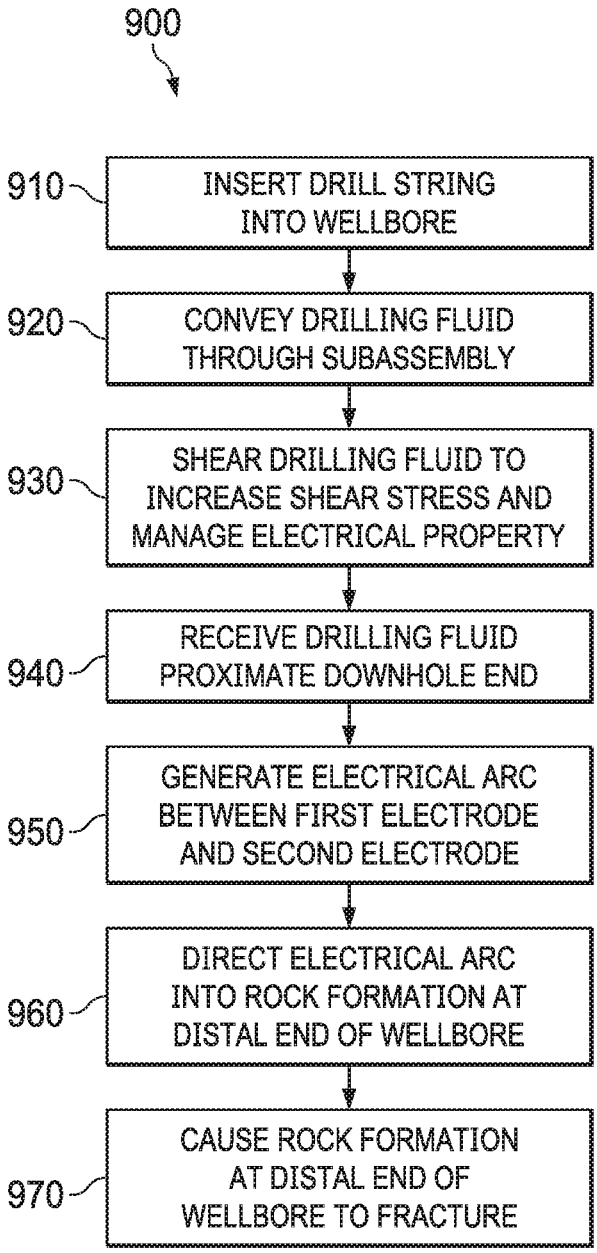
FIG. 9 is a flow chart illustrating an exemplary method for managing the electrical properties of a pulsed-power drilling fluid during a drilling operation.

FIG. 9 is a flow chart illustrating an exemplary method for managing the electrical properties (e.g., the dielectric constant) of a pulsed-power drilling fluid during a drilling operation. Method 900 may begin at step 910. In step 910, a drill string is inserted into a wellbore. For example, drill string 108 may be inserted into wellbore 116 as shown in FIG. 1. The drill string may include subassemblies where at least one of the subassemblies include a downhole mixer. For example, any one of subassemblies 129*a*, 129*b*, or 129*c* within BHA 128 shown in FIG. 1 may include a downhole mixer. The downhole mixer includes a housing having an uphole and a downhole end, a channel that includes an entrance proximate to the uphole end and an exit proximate to the downhole end, and a flow restrictor positioned in the channel between the entrance and the exit. For example, housing 301, channel 310, and flow restrictor 320 of downhole mixer 230 may be positioned within BHA 128 as shown in FIGS. 3 and 4. Alternatively, for example, the downhole mixer may be positioned in interconnecting flow line 130 or 131, in feed pipe 124, or at any other suitable location within drilling system 100.

In step 920, the channel of the downhole mixer conveys drilling fluid having an electrical property through the subassembly. For example, drilling fluid 122 may be conveyed through channel 310 as shown in FIGS. 3 and 4. As described above, the electrical property may be a dielectric constant used by a drill bit to generate an electrical arc into a rock formation.

In step 930, the flow restrictor of the downhole mixer may shear the drilling fluid to increase shear stress in the drilling fluid and to manage its electrical property. For example, as described above with reference to FIGS. 3-8, a downhole mixer may include one or more flow restrictors positioned in the flow path of drilling fluid 122. As described above, these flow restrictors are specifically designed and positioned to shear the drilling fluid. The amount of shearing may be represented by the associated pressure drop across individual flow restrictors or across the downhole mixer.

In step 940, a drill bit coupled to the downhole mixer may receive the drilling fluid from the exit proximate to the downhole end of the channel. As described above, the drill bit may include a first electrode and a second electrode. For example, drilling fluid 122 may exit drill string 108 via openings 209 surrounding each electrode 208 of pulsed-power drill bit 114 as described above with reference to FIGS. 1 and 2.

In step 950, the drill bit may generate an electrical arc between a first electrode and a second electrode, where the electrical arc is associated with the electrical property of the drilling fluid. For example, optimal electrical properties (high dielectric constant, high dielectric strength, and low electric conductivity) of drilling fluid may be restored proximate to drill bit 114, where the optimal electrical properties are used to create an electrical arc into a rock formation.

In step 960, the electrical property of the drilling fluid directs the electrical arc into a rock formation at the distal end of the wellbore. For example, as described above with reference to FIG. 1, the electrical arc temporarily forms an electrical coupling between the electrodes, allowing electric current to flow through the arc inside a portion of the rock formation at the bottom of wellbore 116.

In step 970, the electrical arc of the drill bit causes the rock formation at the distal end of the wellbore to fracture. As described above in relation to FIG. 1, for example, drill bit 114 applies a large electrical potential across the one or more electrodes to form an arc across the drilling fluid proximate to the distal end of wellbore 116. The electrodes of drill bit may be oriented such that a shock wave generated by the arc is transmitted toward the distal end of wellbore 116. When the shock wave contacts and bounces off of the rock at the distal end of wellbore 116, the rock fractures.

In an embodiment A, the present disclosure provides a downhole mixer including a housing having an uphole end and a downhole end, a channel to convey a drilling fluid through the housing, the channel including an entrance proximate the uphole end and an exit proximate the downhole end, and a flow restrictor positioned in the channel between the entrance and the exit, the flow restrictor including an orifice having a fixed diameter to manage an electrical property of the drilling fluid by creating a pressure drop between the entrance and the exit to increase shear stress in the drilling fluid.

The present disclosure further provides in an embodiment B a downhole drilling system including a drill bit and a drill string coupled to the drill bit, the drill string including a downhole mixer including: a housing having an uphole end and a downhole end, a channel to convey a drilling fluid through the housing, the channel including an entrance proximate the uphole end and an exit proximate the downhole end, and a flow restrictor positioned in the channel between the entrance and the exit, the flow restrictor including an orifice having a fixed diameter to manage an electrical property of the drilling fluid by creating a pressure drop between the entrance and the exit to increase shear stress in the drilling fluid.

The present disclosure further provides in an embodiment C a method that includes inserting a drill string into a wellbore, the drill string including a plurality of subassemblies, at least one of the subassemblies including a downhole mixer including: a housing having an uphole end and a downhole end, a channel including an entrance proximate the uphole end and an exit proximate the downhole end, and a flow restrictor positioned in the channel between the entrance and the exit, the flow restrictor including an orifice having a fixed diameter. The method further includes conveying, by the channel of the downhole mixer, a drilling fluid through the at least one subassembly, the drilling fluid having an electrical property, shearing by the flow restrictor of the downhole mixer, the drilling fluid, where the shearing increases shear stress in the drilling fluid and manages the electrical property, receiving, by a drill bit coupled to the downhole mixer, the drilling fluid from the exit proximate the downhole end, the drill bit including a first electrode and a second electrode. In response to the drill bit receiving the drilling fluid, generating, by the drill bit, an electrical arc between the first electrode and the second electrode, the electrical arc associated with the electrical property of the drilling fluid, directing, by the electrical property of the drilling fluid, the electrical arc into a rock formation at a distal end of the wellbore, and causing, by the electrical arc of the drill bit, the rock formation at the distal end of the wellbore to fracture.

Each of embodiments A, B, and C may have one or more of the following additional elements in any combination:

Element 1: wherein the drilling fluid is a pulsed-power drilling fluid and the electrical property is a dielectric constant. Element 2: wherein the flow restrictor includes an elongational flow orifice or an orifice plate. Element 3: wherein the fixed diameter of the orifice is less than 3 inches. Element 4: wherein the downhole mixer is positioned in a bottom-hole assembly. Element 5: wherein the downhole mixer further includes a plurality of flow restrictors selected from a group consisting of an elongational flow orifice, an orifice plate, and combinations thereof. Element 6: wherein the downhole end of the housing is coupled to a drill bit or a pulsed-power drill bit. Element 7: wherein the downhole mixer further includes a baffle positioned in the channel between the entrance and the exit to manage the electrical property of the drilling fluid by creating the pressure drop between the entrance and the exit. Element 8: wherein the pressure drop between the entrance and the exit is of at least 100 psig during a drilling operation. Element 9: wherein the at least one subassembly is a bottom-hole assembly proximate the drill bit. Element 10: wherein the drill bit is a pulsed-power drill bit.

Although the present disclosure has been described with several embodiments, various changes and modifications may be suggested to one skilled in the art. It is intended that the present disclosure encompasses such various changes and modifications as falling within the scope of the appended claims.

What is claimed is:

1. A downhole mixer comprising:

a housing having an uphole end and a downhole end;

a channel to convey a drilling fluid through the housing, the channel including an entrance proximate the uphole end and an exit proximate the downhole end; and a flow restrictor positioned in the channel between the entrance and the exit, wherein the flow restrictor comprises an elongational flow orifice having a fixed diameter at one end of the elongational flow orifice to manage an electrical property of the drilling fluid by creating a pressure drop between the entrance and the exit to increase shear stress in the drilling fluid;

wherein the elongational flow orifice has a length L and at least a first diameter D1, a second diameter D2, and an average inner diameter D, wherein the length L is at least two times the average inner diameter D.

2. The downhole mixer of claim 1, wherein the drilling fluid is a pulsed-power drilling fluid and the electrical property is a dielectric constant.

3. The downhole mixer of claim 1, further comprising a plurality of flow restrictors including at least one elongation flow orifice and one or more flow restrictors selected from a group consisting of an elongational flow orifice, an orifice plate, and combinations thereof.

4. The downhole mixer of claim 1, wherein the downhole end of the housing is coupled to a drill bit or a pulsed-power drill bit.

5. The downhole mixer of claim 1, wherein the downhole mixer further comprises a baffle positioned in the channel between the entrance and the exit to manage the electrical property of the drilling fluid by creating the pressure drop between the entrance and the exit.

6. The downhole mixer of claim 1, wherein the pressure drop between the entrance and the exit is of at least 100 psig during a drilling operation.

7. The downhole mixer of claim 1, wherein the flow restrictor comprises an elongational flow orifice having a length L and an orifice plate at one end thereof, wherein the fixed diameter is less than 3 inches.

8. A downhole drilling system comprising:

a drill bit; and a drill string coupled to the drill bit, the drill string including a plurality of subassemblies, at least one subassembly including a downhole mixer comprising:

a housing having an uphole end and a downhole end;

a channel to convey a drilling fluid through the housing, the channel including an entrance proximate the uphole end and an exit proximate the downhole end; and a flow restrictor positioned in the channel between the entrance and the exit, wherein the flow restrictor comprises an elongational flow orifice having a fixed diameter to manage an electrical property of the drilling fluid by creating a pressure drop between the entrance and the exit to increase shear stress in the drilling fluid;

wherein the elongational flow orifice has a length L and at least a first diameter D1, a second diameter D2, and an average inner diameter D, wherein the length L is at least two times the average inner diameter D.

9. The downhole drilling system of claim 8, wherein the drilling fluid is a pulsed-power drilling fluid and the electrical property is a dielectric constant.

10. The downhole drilling system of claim 8, wherein the at least one subassembly is a bottom-hole assembly proximate the drill bit.

11. The downhole drilling system of claim 8, further comprising a plurality of flow restrictors including at least one elongation flow orifice and one or more flow restrictors selected from a group consisting of an elongational flow orifice, an orifice plate, and combinations thereof.

12. The downhole drilling system of claim 8, wherein the drill bit is a pulsed-power drill bit.

13. The downhole drilling system of claim 8, wherein the downhole drilling system further comprises a baffle positioned in the channel between the entrance and the exit to manage the electrical property of the drilling fluid by creating the pressure drop between the entrance and the exit.

14. A method comprising:

inserting a drill string into a wellbore, the drill string including a plurality of subassemblies, at least one of the subassemblies including a downhole mixer comprising:

a housing having an uphole end and a downhole end;

a channel including an entrance proximate the uphole end and an exit proximate the downhole end; and a flow restrictor positioned in the channel between the entrance and the exit, the flow restrictor including an orifice having a fixed diameter;

conveying, by the channel of the downhole mixer, a drilling fluid through the at least one subassembly, the drilling fluid having an electrical property;

shearing, by the flow restrictor of the downhole mixer, the drilling fluid, wherein the shearing increases shear stress in the drilling fluid and manages the electrical property;

receiving, by a drill bit coupled to the downhole mixer, the drilling fluid from the exit proximate the downhole end, the drill bit including a first electrode and a second electrode; and in response to the drill bit receiving the drilling fluid:

generating, by the drill bit, an electrical arc between the first electrode and the second electrode, the electrical arc associated with the electrical property of the drilling fluid;

directing, by the electrical property of the drilling fluid, the electrical arc into a rock formation at a distal end of the wellbore; and causing, by the electrical arc of the drill bit, the rock formation at the distal end of the wellbore to fracture.

15. The method of claim 14, wherein the drilling fluid is a pulsed-power drilling fluid and the electrical property is a dielectric constant.

16. The method of claim 14, wherein the at least one subassembly is a bottom-hole assembly proximate the drill bit.

17. The method of claim 14, wherein the flow restrictor comprises an elongational flow orifice or an orifice plate.

18. The method of claim 14, wherein the downhole end of the housing is coupled to a drill bit or a pulsed-power drill bit.

19. The method of claim 14, wherein the downhole mixer further comprises a baffle positioned in the channel between the entrance and the exit to manage the electrical property of the drilling fluid by creating a pressure drop between the entrance and the exit.

* * * * *